US006184815B1

(12) United States Patent
Carlson

(10) Patent No.: US 6,184,815 B1
(45) Date of Patent: Feb. 6, 2001

(54) TRANSMISSION LINE ELECTROMAGNETIC REFLECTION REDUCTION TREATMENT

(76) Inventor: Marvin Lee Carlson, P.O. Pox 1712, Fwd, TX (US) 77549

( * ) Notice: Under 35 U.S.C. 154(b), the term of this patent shall be extended for 0 days.

(21) Appl. No.: 09/213,474

(22) Filed: Dec. 17, 1998

(51) Int. Cl.[7] ..... H01Q 17/00
(52) U.S. Cl. ..... 342/4; 342/1; 342/2
(58) Field of Search ..... 342/1–12

(56) References Cited

U.S. PATENT DOCUMENTS

| | | | | |
|---|---|---|---|---|
| 2,656,535 | * | 10/1953 | Neher | 342/4 |
| 3,290,680 | | 12/1966 | Wesch . | |
| 3,508,265 | | 4/1970 | Ellis . | |
| 4,086,591 | | 4/1978 | Siwiak . | |
| 4,353,069 | | 10/1982 | Handel . | |
| 4,480,256 | | 10/1984 | Wren . | |
| 4,539,433 | | 9/1985 | Ishino . | |
| 4,716,417 | | 12/1987 | Gramet . | |
| 4,924,228 | * | 5/1990 | Novak et al. | 342/2 |
| 5,008,679 | | 4/1991 | Effland et al. | 342/353 |
| 5,016,015 | * | 5/1991 | Novak et al. | 342/2 |
| 5,276,447 | * | 1/1994 | Shingo | 342/2 |
| 5,394,150 | * | 2/1995 | Naito et al. | 342/4 |
| 5,570,096 | | 10/1996 | Knight et al. | 342/357 |
| 5,594,452 | | 1/1997 | Webber et al. | 342/353 |
| 5,731,777 | * | 3/1998 | Reynolds | 342/4 |
| 5,845,877 | * | 12/1998 | Justice et al. | 342/4 X |

OTHER PUBLICATIONS

Robert W. Landee, Donovan C. Davis, Albert P. Albrecht Electronic Designers Handbook, 1977, pp. 8–3 to 8–10 Second Edition, McGraw–Hill Book company, NY NY.

Robert W. Landee, Donovan C. Davis, Albert Albrecht Electronic Designers Handbook, 1977 pp. 8–47 and 8–52 to 8–53 Second Edition, McGraw–Hill Book Company NY, NY.

* cited by examiner

*Primary Examiner*—Bernarr E. Gregory

(57) ABSTRACT

A transmission line electromagnetic reflection reduction treatment is disclosed herein. This invention relates to radar cross section reduction in vehicles including aircraft, submarines, warships, tanks, troop carriers, and mobile weapons, and reduction of electromagnetic (EM) interference from civil engineering structures including bridges, buildings, power lines, and antennas.

23 Claims, 7 Drawing Sheets

TRANSMISSION LINE ELECTROMAGNETIC REFLECTION REDUCTION TREATMENT

BACKGROUND

1. Field of Invention

This invention relates to radar cross section reduction in vehicles including aircraft, submarines, warships, tanks, troop carriers, and mobile weapons, and reduction of electromagnetic (EM) interference from civil engineering structures including bridges, buildings, power lines, and antennas.

2. Description of Prior Art

EM absorbers are often add-ons giving vehicles parasitic (contributing neither to structure nor aerodynamic performance) weight and drag, and degrading the flight performance of vehicles.

Salisbury Screens, Dallenbach Layers, and Multilayered Treatments are high volume treatments that are rendered ineffective by surface water from waves or weather. This limits effectiveness when deployed in inclement weather and marine environments. High-volume treatments cannot be deployed in volume-limited situations. Nuclear, biological and chemical (NBC) effects on the spacing materials deteriorate long term performance of high volume treatments in tropical, marine, chemical warfare, and nuclear battlefield environments.

Resistance cards and artificial dielectrics are subject to NBC effects on supporting materials. Resistance cards and artificial dielectrics cannot be deployed in volume-limited situations. Resistance cards and artificial dielectrics are of little use, and often are detrimental in bistatic scattering conditions. When scattering is out of the plane of the resistance card or artificial dielectric, it renders these treatments ineffective.

High-angle bistatic scattering renders high volume treatments, resistance card treatments, and artificial dielectric treatments ineffective against such problems as detection by certain surface-to-air missiles and phased array defense systems, and radio interference from civil engineering structures such as bridges, buildings, power lines, and antennas.

Magnetic Radar Absorbing Material (MAGRAM) is heavy, which limits vehicle ranges and degrades weight and balance envelopes. MAGRAM tends to be most effective at the low-frequency end of the radar spectrum, making MAGRAM ineffective against most targeting radars.

Shaping to reduce EM signature degrades aerodynamic performance and changes weight and balance in aircraft design.

Short life and poor erosion characteristics limit use of the above treatments on the forward sectors of propellers, rotors, and similar objects.

Low observable vehicles can make local air traffic control difficult in friendly air space.

OBJECTS AND ADVANTAGES

1. This is a low-weight treatment which can be applied with little disturbance to aircraft weight and balance.

2. This treatment allows the use of structural materials, making it a load-bearing treatment rather than a parasitic add-on.

3. This treatment may be laid into composites, making the treatment an integral part of the structure.

4. This treatment works even when wet, maintaining effectiveness in inclement weather and marine applications.

5. This treatment may be constructed of metal and sealed plastics, making the treatment weather resistant and water resistant.

6. This treatment has little volume, and allows preservation of aerodynamic aircraft shaping.

7. Exposed surfaces can be made of materials (nonmagnetic stainless steels, for example) which are resistant to NBC attack.

8. This treatment is effective for monostatic and bistatic scattering for enhanced performance against detection by surface-to-air missiles and phased-array defense systems, and radio interference from civil engineering structures.

9. This treatment has broad-band frequency performance.

10. This treatment can reduce undesirable signal returns from civil engineering structures including bridges, buildings, power lines, and antennas.

11. This treatment may be deployed in tape form or sheet form to quickly treat or modify vehicles, and civil engineering structures including bridges, buildings, power lines, and antennas.

12. The low weight and volume and the load bearing materials of this treatment allow its application to metallic rain/sand erosion strips on the forward sectors of propellers, rotors and similar objects.

13. This treatment can be made active through the use of semiconductors in the treatments, allowing it to be deactivated while not on mission status.

The above mentioned and other objects, features and advantages will become apparent from consideration ofthe ensuing description and drawings.

BRIEF DESCRIPTION OF THE DRAWING FIGURES

REFERENCE NUMERALS IN DRAWINGS

Figure 1:
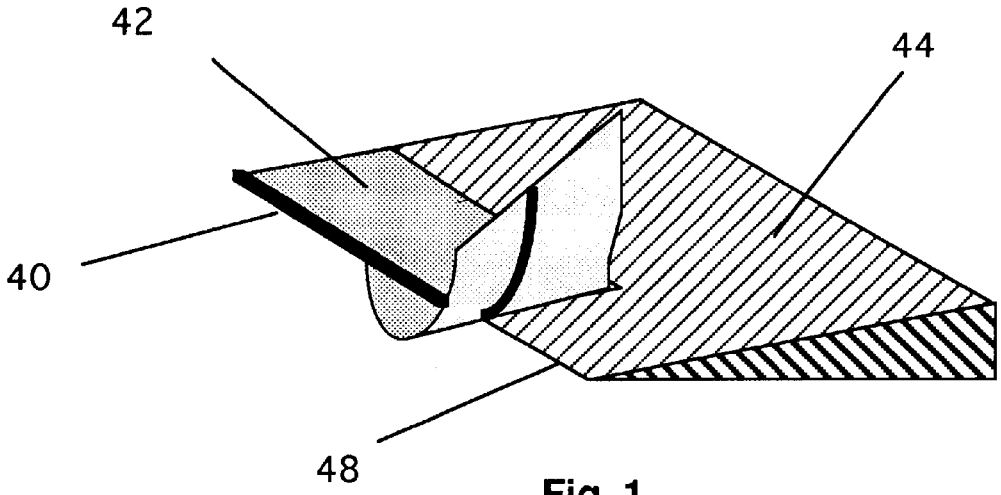
FIG. 1 illustrates an edge of a target treated with an electromagnetically loaded conductive strip (ELCS) and a dielectric spacer, representing a single-ELCS application.

40 electromagnetically loaded conductive strip (ELCS)
42 dielectric spacer

44 target
46 max spacing distance Lmax
48 edge of target
50 2 times Lmax
52 electrical lead
54 conducting section
56 resistive section
58 conductive strip
60 bead
62 closed path
64 switchable element
66 dielectric tape
68 aerodynamic wing
70 multiple-ELCS surface treatment
72 gap
74 edge treatment
76 single-ELCS treatment
78 aerodynamic body
80 building
82 ground plane

SUMMARY

In accordance with the present invention, a structure to attenuate reflection of EM radiation of a given frequency range comprises properly-spaced long strips of electrically loaded conductive material, and a dielectric spacer.

DESCRIPTION

FIGS. 1 to 9B

A typical embodiment of the treatment of the present invention is illustrated in FIG. 1 as applied to a target 44. The target edge 48 is representative of a plurality of surfaces coming together at a boundary that is geometrically sharp, i.e the radius of curvature at the joining of the surfaces is less than one eighth wavelength at the highest treated frequency. An electrically loaded conductive strip (ELCS) 40 is positioned within a distance Lmax of the target through inclusion of a dielectric spacer 42 in the treatment. The distance Lmax is one quarter of the wavelength of the highest operating frequency of the incident radiation. The ELCS consists of a conductive strip, which in the broad-frequency embodiments includes periodically-spaced electromagnetic elements as described below.

Figure 2A:
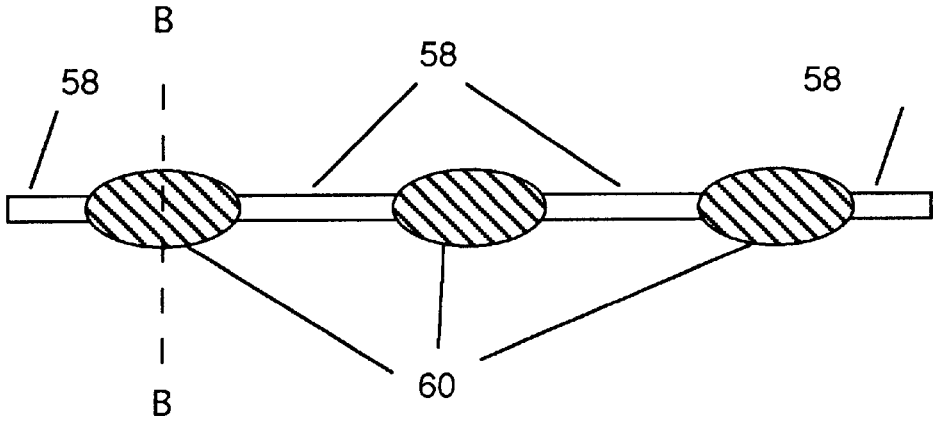
FIGS. 2A and 2B represent a side view and cross section respectively of an ELCS comprising magnetic beads on a wire.
Figure 2B:
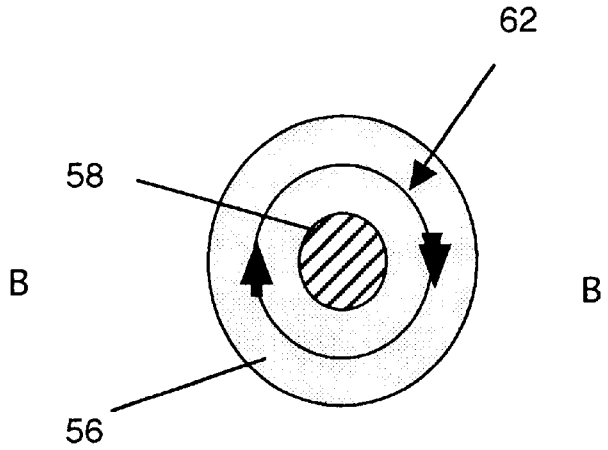

In one preferred embodiment, as shown in FIG. 2A, ELCS 40 consists of a strip of conductive material 58 (e.g. wire) with magnetic beads 60 on the strip of conductive material. A bead is material added to the outside of the conductive strip encircling the strip in a closed path. FIG. 2B shows a cross section of FIG. 2A at BB showing a closed path 62 around the conductive strip.

Figure 3:
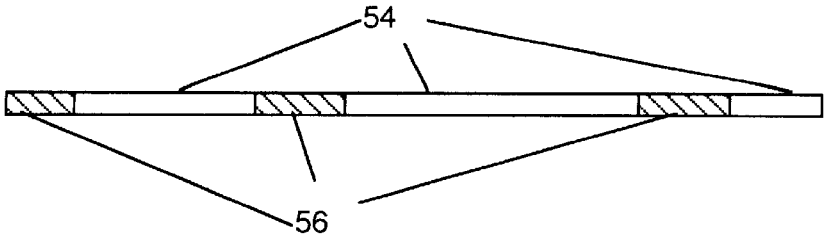
FIG. 3 is a side view of a single-ELCS treatment.

In another preferred embodiment the ELCS comprises conducting sections 54 joined by resistive sections 56 as in FIG. 3. Joining sections include any combination of resistive elements, switchable elements, magnetic beads and dielectric elements. Resistive material is material that is electrically conductive with low-to moderate internal resistivity, e.g. graphite. Switchable elements can be set either to carry or interrupt electrical current. Examples of switchable elements include magnetic reed switches, transistors, and vacuum tubes.

Figure 4A:
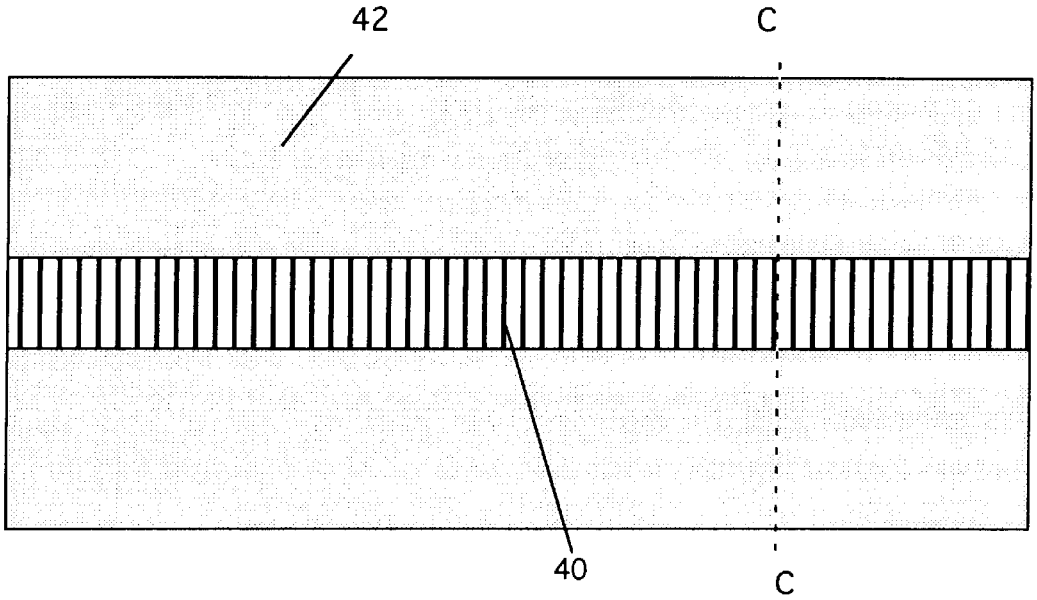
FIGS. 4A and 4B are side and cross sectional views respectively of a single-ELCS treatment.
Figure 4B:
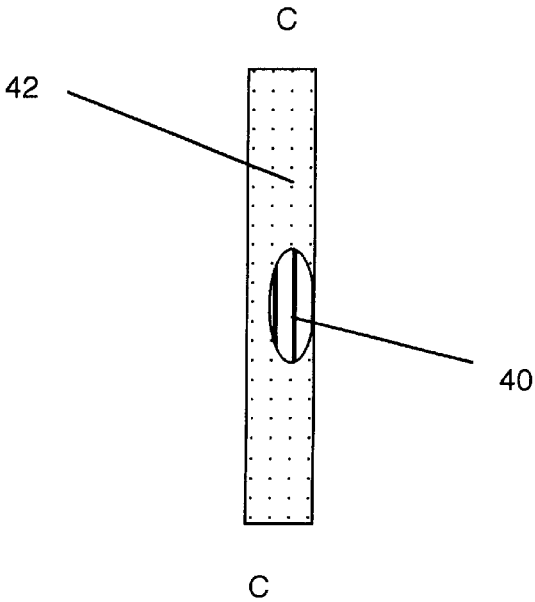

FIG. 4A shows the placement of ELCS 40 in a dielectric spacer 42 where the dielectric spacer is in tape form. The cross section at CC in FIG. 4B shows the placement of ELCS 40 within dielectric spacer 42. Dielectric material is non-conducting, e.g. fiberglass.

Figure 5A:
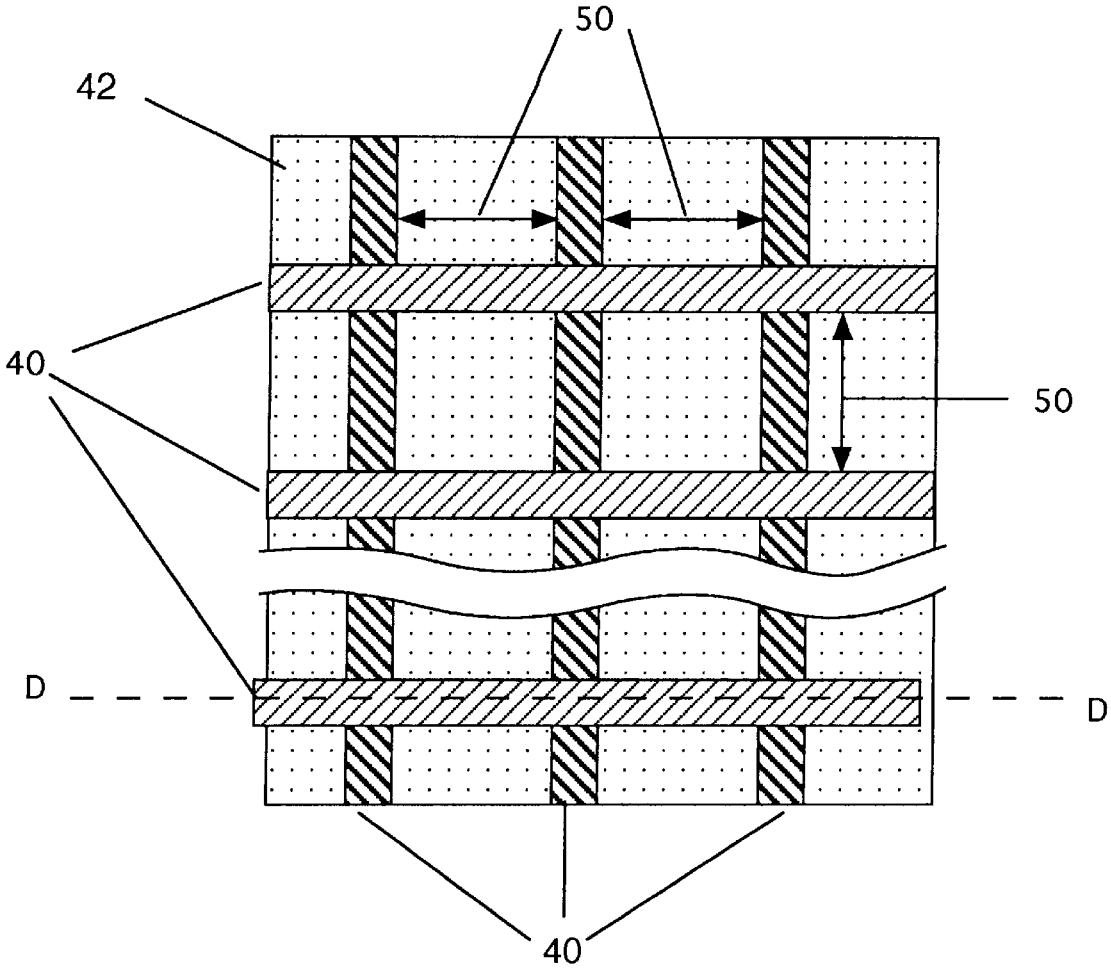
FIGS. 5A and 5B are side and cross sectional views respectively of a multiple-ELCS treatment.

Another preferred embodiment of this invention is the multiple-ELCS surface treatment shown in FIG. 5A. FIG. 5A shows the placement of multiple ELCS 40 within dielectric spacer 42 at spacing of less than two times Lmax 50. Adjacent ELCS 40 that are crossing in this view are not in electrical contact.

Figure 5B:
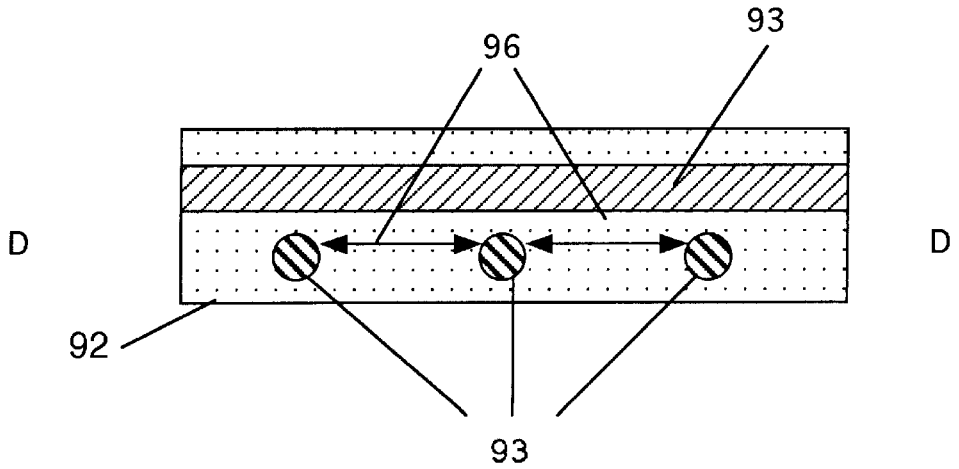

FIG. 5B shows a cross section of a multiple-ELCS treatment from FIG. 5A at DD and the placement of multiple-ELCS 40 spaced at a spacing of less than Lmax from target 44. None ELCS 40 shown in this view are in electrical contact with each other.

Figure 6:
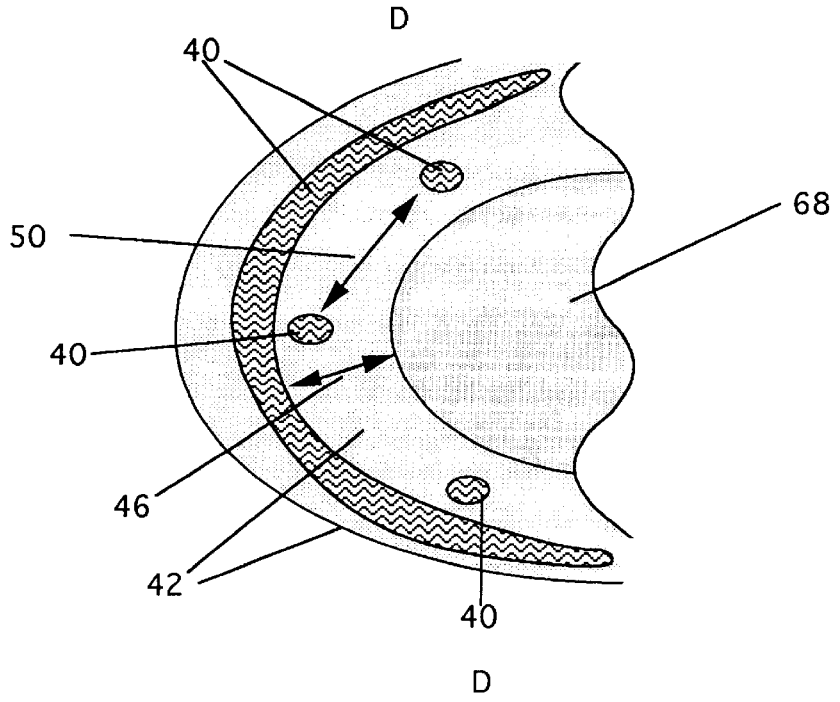
FIG. 6 is a cross sectional view of 5A mounted on an aerodynamic wing.

FIG. 6 illustrates the surface treatment of the leading edge of an aerodynamic wing 68 to reduce electromagnetic signal return. Dielectric spacer 42, in this illustration dielectric tape, contains multiple ELCS 40.

Figure 7:
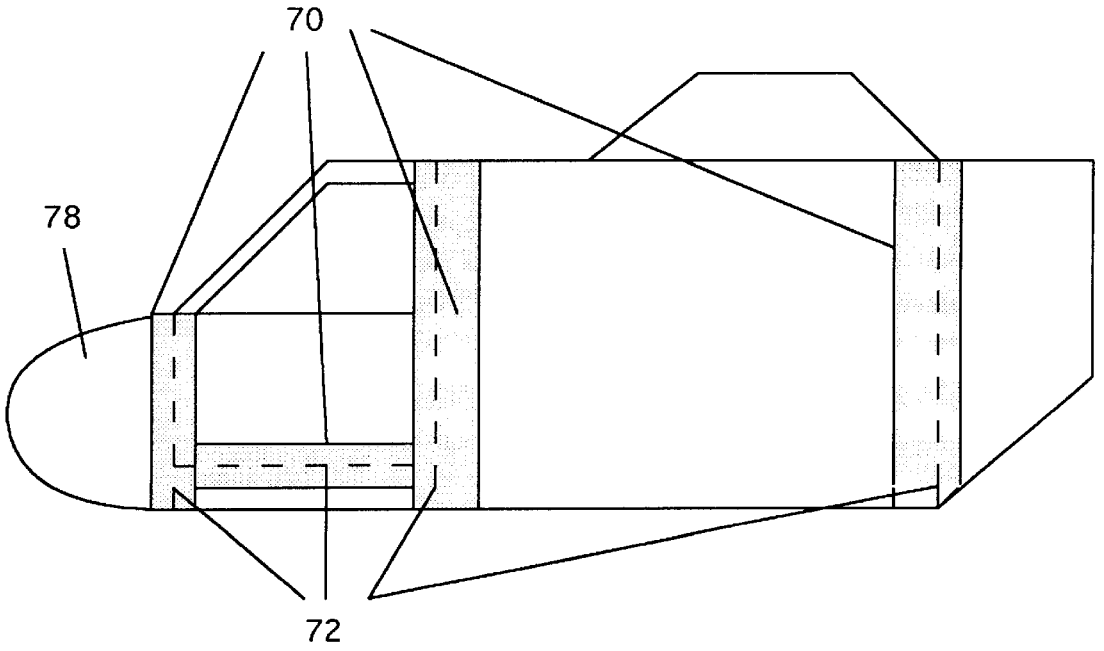
FIG. 7 represents an aerodynamic body retrofitted with a multiple-ELCS treatment.

FIG. 7 illustrates a multiple-ELCS surface treatment 70 placed on gaps 72 between panels of an aerodynamic body 78.

Figure 8A:
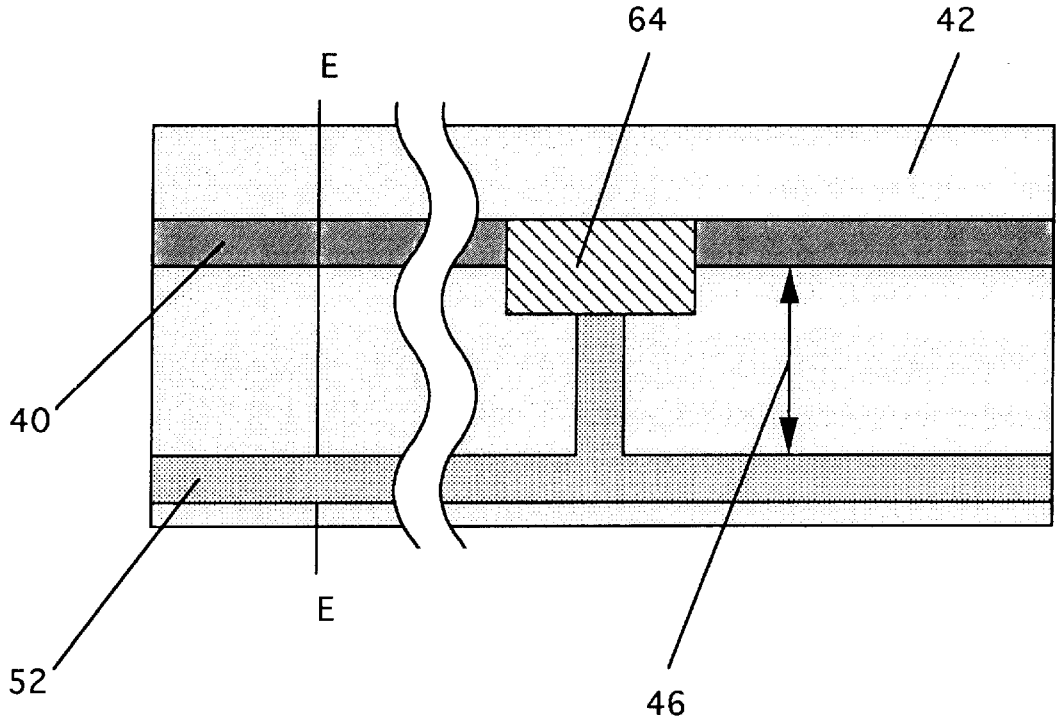
FIGS. 8A and 8B are schematic views of a treatment with a single-lead switchable element.

FIG. 8A illustrates an embodiment of a treatment with a single-lead switchable element 64 attached to lead 52. The dielectric spacer 42, maintains a distance of Lmax between ELCS 40 and electrical lead 52. This embodiment is applicable to vehicles that are desired to have return when not in a threat situation, e.g. combat aircraft that are flying in a friendly air traffic control area. Switchable elements are devices capable of conducting or interrupting current flow in ELCS on demand, e.g. transistors. Switchable elements are periodically located a maximum distance apart of 2 times Lmax. The switchable elements for each ELCS are attached to a single lead to provide controlling signals to switchable elements. Leads are strips of conductor surrounded by dielectric, used to operate switching in switchable elements.

Figure 8B:
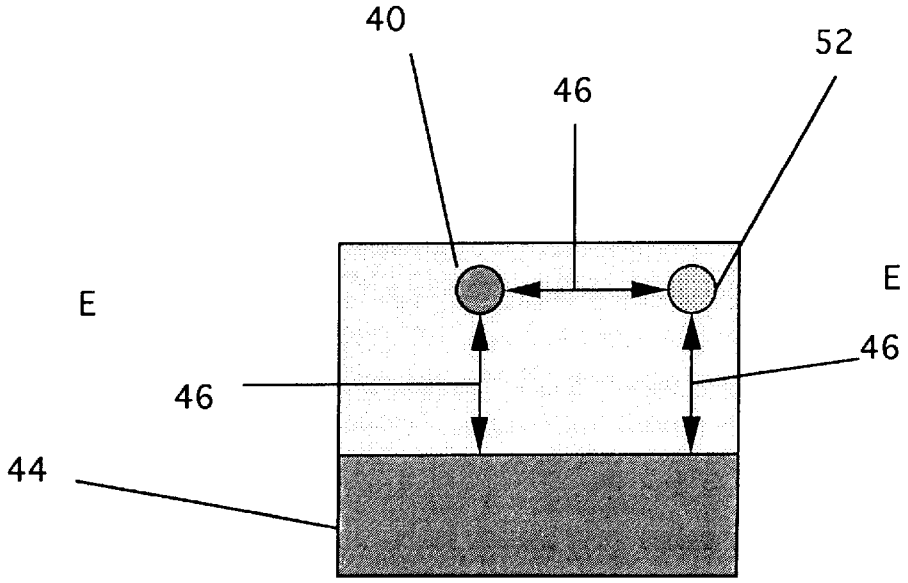

FIG. 8B is a cross section of 8A at EE showing the respective positions of ELCS 40 and electrical lead 52 within the treatment. Lead 52 is a maximum distance of Lmax from ELCS and a maximum distance Lmax from the target 44. A controlling signal (e.g. DC voltage) is applied between ELCS 40 and lead 52.

Figure 9A:
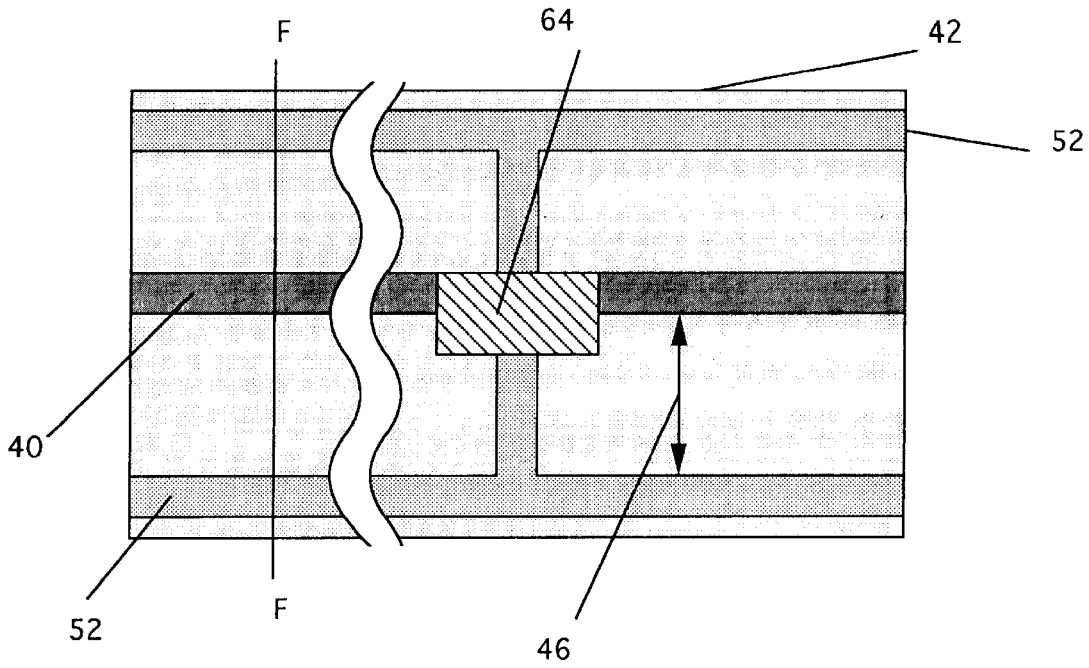
FIGS. 9A and 9B are schematic views of a treatment with a double-lead switchable element.

FIG. 9A illustrates an embodiment with a double lead switchable element 64. Examples of double lead switchable elements include logic circuits, Hall effect devices and reed switches.

Figure 9B:
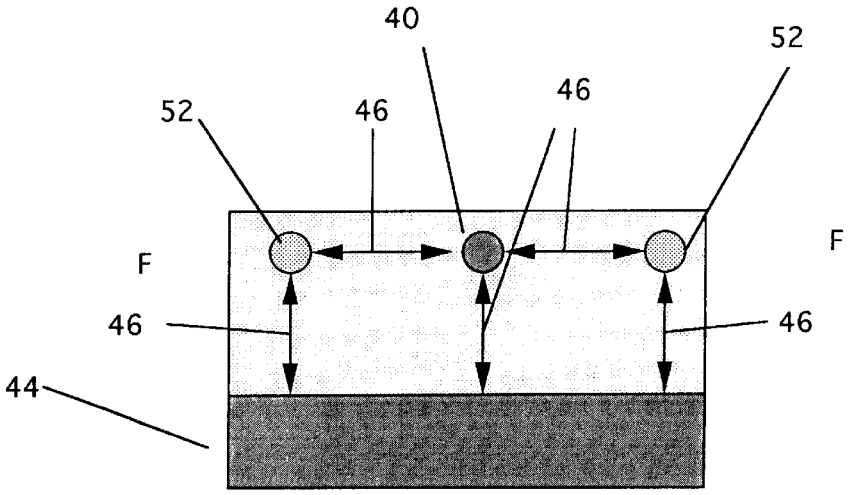

FIG. 9B is a cross section of 9A at FF showing the respective positions of ELCS 40 and lead 52 within the treatment. A controlling signal (e.g. DC voltage)is applied between the two leads 52.

OPERATION

FIGS. 1, 2A, 3, 5A, 6, 7, 10, 11A, 11B

Figure 11A:
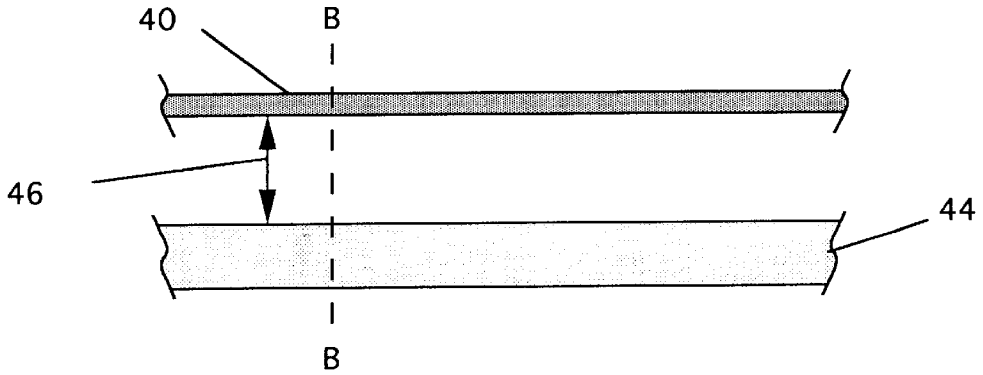
FIGS. 11A and 11B are schematic representations of a side view and a cross section respectively of a strip transmission line.
Figure 11B:
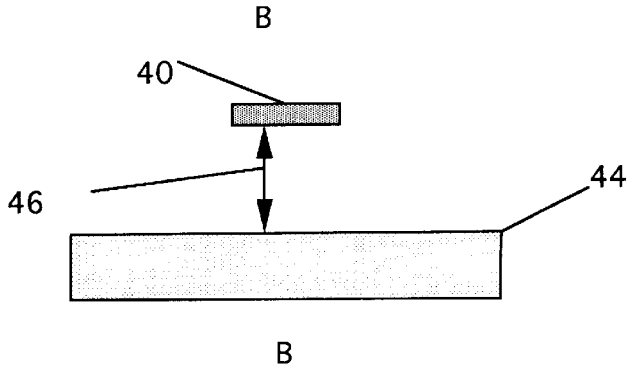

The treatment works by matching the impedance of a target to free space through use of a transmission line. The combination of a treatment and a target form a strip transmission line, so the methods for impedance matching in transmission lines are directly transferrable to impedance matching in this treatment. FIGS. 11A and 11B are a side view and across section respectively of a strip transmission line. Where target 44 becomes a ground plane of a transmission line as long as strip 40 and ground plane or target 44 are within a distance Lmax 50 of each other. The periodic loading of ELCS 40 at periods of at least one half the wavelength of the lowest frequency of the treatment design, provides impedance matching to free space and at discontinuities, resulting in absorption of specular, traveling, and creeping waves.

The simplest of the embodiments is used in the case where the target is linear and the attenuated radiation is of a single frequency, as in the case of an antenna experiencing interference from a near by airport radar. The treatment can simply be a wire with no electrical loading positioned by the dielectric spacer at Lmax from the target.

In Electronics Designer Handbook (R. W. Landee et al) on page 8–9 the transmission line equation 8.51 is shown for calculation of impedance of a given transmission line, otherwise referred to as the transmission line equation. The transmission line equation is used to design ELCS for specific frequency ranges. Dielectric, magnetic, and resistive elements are placed in the transmission line to eliminate reflection across the given frequency range by matching free space impedance, 377 ohms, to the target impedance. Placement of elements is determined by the transmission line equation. If the treatment thus designed is at least one quarter the wavelength of the lowest frequency of the treatment design, then the treatment may be reflected for a symmetric treatment of one half wavelength at the lowest design frequency length. These treatments may be combined into a treatment of any length with periods of half wavelength at the lowest design frequency.

An example of such a treatment FIG. 2A, magnetic material forms a bead 60 around a conductive strip. The cross section of the magnetic material is elliptical with the semi-major axis in the direction of the conductive strip 58, and the semi-minor axis perpendicular to the strip. The magnetic material used is measured in a dielectrometer and the magnetic and electric constants are determined. The semi-major axis is sized so that, with the given material, impedance matches free space. The part of the strip that is not covered 58 matches the impedance of the ground plane. The elliptical shape of the bead 60 provides impedance matching for all frequencies from a low where the semi major axis of the bead is one half the longest wavelength of the material, to the high frequency limit of the material. The treatment is terminated where the impedance matches the target.

Another example of a treatment FIG. 3 is where resistive sections 56 are in the strip 54 forming resonant sections in the transmission line. Multiple resonant sections are formed at unequal intervals to form a quarter wavelength treatment at the lowest frequency. Again these are reflected to form half wave treatments, and half wave treatments joined to form any length. A classic example of this is a logarithmic spacing.

Other analytically correct treatments with combinations of resistive, dielectric, and magnetic treatments may be made for absorption in specific frequencies rather than complete frequency bands. Antennas of a wide variety of shapes cold benefit from this type of treatment. Especially where frequency selective surfaces are inadequate to the task.

Technology for creating ELCS already exists in transmission line technology. Numerous transmission line programs exist for design optimization of ELCS. Resonant sections, filters and RF chokes are some of the readily available components for ELCS treatment.

The transmission line treatment attenuates radiation on the ground plane within one quarter wavelength of the conductor. To attenuate radiation across a broader area, put additional treatments within one half wavelength of each other.

The transmission line treatment attenuates the parallel component of EM radiation impinging on the treatment. To attenuate EM radiation of other polarizations, crossing treatments, not in electrical contact with the first set are used. Treatments perpendicular to the first set of treatments will have uniform attenuation with respect to all polarizations. Other patterns of skew treatments, such as hexagonal or triangular may be used.

The original inclusion of an electromagnetic return reduction treatment into the fabrication of composite structures may be accomplished by including the electromagnetic absorbing structures directly into sheets which serve as a lay-up fabric for the structure.

FIG. 1 shows treatment of an existing target edge 48 can be accomplished by an application of a tape 66 with a single-ELCS edge treatment 76, directly to the existing target edge.

The treatment of an existing surface can be accomplished by an application of a tape as in FIG. 5A with multiple-ELCS surface treatment 70, directly to an existing surface. In treatment is applied directly on the surface where scattering is to be reduced. FIG. 6 shows a cross section of an application of a multiple-ELCS surface treatment 70 to an aerodynamic leading edge 68. FIG. 7 shows application of a surface treatment 70 on scattering areas e.g. gaps 72 on an aerodynamic body 78.

Figure 10:
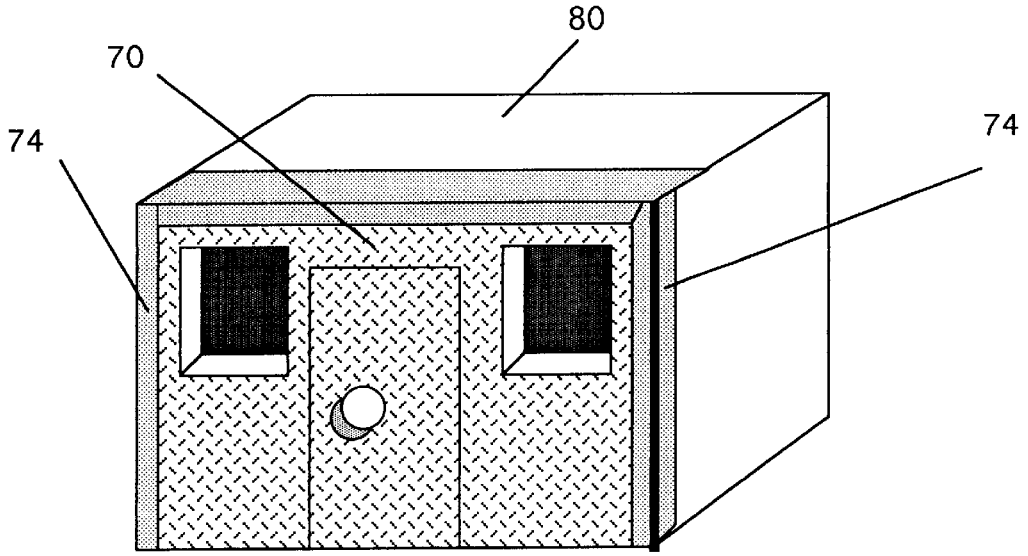
FIG. 10 is a civil engineering structure treated to reduce electromagnetic return.

FIG. 10 shows treatment for reduction of ground clutter for fixed radar from civil engineering structures. With an appropriate application of surface treatments 70 and edge treatments 74, signal return from the building 80 is reduced, and thus ground clutter is reduced.

Treatments containing switching elements are applied as edge or surface treatments depending on the geometry of the target. The leads of such a treatments are connected to power and control circuits. When switchable treatments are activated, decreased electromagnetic return results. Treatments may be designed as either activated or deactivated (normally on or normally off) by activation of the control circuit.

CONCLUSION, RAMIFICATIONS AND SCOPE

Accordingly, the reader will see that the transmission line treatment of this invention provides a robust solution to reduction of EM scattering of radiation.

Although the description above contains many specificities, these should not be construed as limiting the scope of the invention but as merely providing illustrations of some of the presently-preferred embodiments of this invention. For example the patterns of multiple-ELCS may be other than strictly parallel and perpendicular; the patterns of ELCS may be hexagonal, wavy or arced; a target can be conductive, resistive, or dielectric, etc.

Thus the scope of the invention should be determined by the appended claims and their legal equivalents, rather than the examples given.

I claim:

1. A structure to attenuate reflection of electromagnetic radiation of a given frequency range from a plurality of surfaces coming together at an edge, comprising:

a. a long continuous strip of conductive material where the width of said strip is less than ¼ wavelength at the maximum frequency in the given frequency range, b. a dielectric spacer that maintains not greater than ¼ wavelength separation at the maximum frequency in the given frequency range, between said edge and said strip, whereby the electromagnetic return signal from said edge is significantly reduced.

2. The structure to attenuate electromagnetic radiation of claim 1 wherein said spacer is a dielectric tape in which said strip is incorporated.

3. The structure to attenuate electromagnetic radiation of claim 1 wherein said strip of conductive of material is placed through a plurality of beads of material of magnetic permeability greater than the magnetic permeability of vacuum.

4. The structure to attenuate electromagnetic radiation of claim 3 wherein said space is a dielectric tape in which said beads and said strip are incorporated.

5. The structure to attenuate electromagnetic radiation of claim 1 wherein said strip is joined by continuous sections of dielectric material.

6. The structure to attenuate electromagnetic radiation of claim 5 wherein said space is a dielectric tape in which said dielectric material and said strip are incorporated.

7. The structure to attenuate electromagnetic radiation of claim 1 strip is joined by continuous sections of resistive material.

8. The structure to attenuate electromagnetic radiation of claim 7 wherein said space is a dielectric tape in which said resistive sections of material and said strip are incorporated.

9. The structure to attenuate electromagnetic radiation of claim 1 wherein said strip of conductive of material is joined by switchable elements.

10. The structure to attenuate electromagnetic radiation of claim 9 wherein said space is a dielectric tape in which said switchable elements and said strip are incorporated.

11. The structure to attenuate electromagnetic radiation of claim 9 in which electrical leads to said switchable elements are incorporated.

12. A structure to attenuate reflection of electromagnetic radiation of a given range of frequencies comprising:

a plurality of long continuous strips of conductive material where the width of said strips is less than ¼ wavelength at the maximum frequency in the given frequency range, and b. a dielectric spacer that maintains a separation of less than ¼ wavelength at the maximum frequency in the given frequency range between reflecting structure and said strips and, c. said plurality of strips are separated from each other by less than ½ wavelength at the maximum frequency in the given frequency range, whereby the electromagnetic return signal from said structure is significantly reduced.

13. The structure to attenuate electromagnetic radiation of claim 12 wherein said strips form crossing pattern, whereby multiple polarizations of the electromagnetic return signal from said structure is significantly reduced.

14. Said structure to attenuate electromagnetic radiation of claim 13 wherein said space is a dielectric tape in which said beads and said strips are incorporated.

15. The structure to attenuate electromagnetic radiation of claim 12 wherein said space is a dielectric tape in which said strips are incorporated.

16. The structure to attenuate electromagnetic radiation of claim 12 wherein said strips of conductive of material are placed through a plurality of beads of material of magnetic permeability greater than the magnetic permeability of vacuum.

17. The structure to attenuate electromagnetic radiation of claim 12 wherein said strip is joined by continuous sections of dielectric material.

18. The structure to attenuate electromagnetic radiation of claim 17 wherein said space is a dielectric tape in which said sections of dielectric material and said strip are incorporated.

19. The structure to attenuate electromagnetic radiation of claim 12 wherein said strips are joined by continuous sections of resistive material.

20. The structure to attenuate electromagnetic radiation of claim 12 wherein said space is a dielectric tape in which said sections of resistive material and said strips are incorporated.

21. The structure to attenuate electromagnetic radiation of claim 12 wherein said strips of conductive of material are joined by switchable elements.

22. The structure to attenuate electromagnetic radiation of claim 21 wherein said space is a dielectric tape in which said switchable elements and said strips are incorporated.

23. The structure to attenuate electromagnetic radiation of claim 21 in which electrical leads to said switchable elements are incorporated.

* * * * *